US009545356B2

(12) United States Patent
Heaton et al.

(10) Patent No.: US 9,545,356 B2
(45) Date of Patent: Jan. 17, 2017

(54) THERAPEUTIC HAND EXERCISE DEVICE

(75) Inventors: Keith Patrick Heaton, Poole Dorset (GB); Ian James Hardman, Bournemouth (GB)

(73) Assignee: I2R MEDICAL LIMITED, Bournemouth Dorset (GB)

( * ) Notice: Subject to any disclaimer, the term of this patent is extended or adjusted under 35 U.S.C. 154(b) by 1016 days.

(21) Appl. No.: 13/639,301

(22) PCT Filed: Apr. 6, 2011

(86) PCT No.: PCT/GB2011/050685

§ 371 (c)(1), (2), (4) Date: Dec. 7, 2012

(87) PCT Pub. No.: WO2011/124917

PCT Pub. Date: Oct. 13, 2011

(65) Prior Publication Data

US 2013/0072836 A1 Mar. 21, 2013

(30) Foreign Application Priority Data

Apr. 6, 2010 (GB) ..... 1005708.1

(51) Int. Cl.
*A61H 9/00* (2006.01)
*A61H 1/02* (2006.01)
(Continued)

(52) U.S. Cl.
CPC ..... *A61H 9/0007* (2013.01); *A61H 1/0288* (2013.01); *A61H 9/0078* (2013.01);
(Continued)

(58) Field of Classification Search
CPC .... A63B 23/16; A61H 1/0285; A61H 1/0288; A61H 2201/1238; A61H 9/0078; A61H 9/00; A61H 9/0021; A61H 9/0028; A61H 2009/0035; A61H 2009/0042; A61H 33/0087
See application file for complete search history.

(56) References Cited

U.S. PATENT DOCUMENTS 3,581,740 A 6/1971 Sherbourne
3,712,298 A * 1/1973 Snowdon ..... A61H 9/0071 601/11

(Continued)

FOREIGN PATENT DOCUMENTS

EP 0421368 A1 4/1991

*Primary Examiner* — Justine Yu
*Assistant Examiner* — LaToya M Louis
(74) *Attorney, Agent, or Firm* — Fraser Clemens Martin & Miller LLC; Jacob M. Ward

(57) ABSTRACT

A therapeutic hand exercise device includes one or more pliant sleeves (5) for attachment to one or more digits of a human hand, a chamber (4) provided in at least a dorsal region of the or each pliant sleeve (5), a liquid inlet to the chamber and a pump (3) for supplying pressurized liquid to the or each chamber. Each pliant sleeve (5) is movable between a relaxed state and a stiffened state in which the pliant sleeve forms a substantially rigid elongate member for holding a finger disposed within the sleeve in an extended position. A resilient member (6) is fitted to the palmar side of each pliant sleeve which returns the finger to a state of contracture.

20 Claims, 4 Drawing Sheets

(51) Int. Cl.
*A61H 23/02* (2006.01)
*A63B 21/00* (2006.01)
*A63B 23/16* (2006.01)

(52) U.S. Cl.
CPC ... *A61H 23/0263* (2013.01); *A63B 21/00178* (2013.01); *A61H 2201/0207* (2013.01); *A61H 2201/0242* (2013.01); *A63B 23/16* (2013.01)

(56) References Cited

U.S. PATENT DOCUMENTS 3,872,526 A * 3/1975 Betts ..... A47C 21/006 5/109
3,937,215 A 2/1976 Barthlome
4,274,399 A 6/1981 Mummert
4,317,452 A * 3/1982 Russo ..... A61M 27/00 604/541
4,576,148 A 3/1986 Koerner et al.
4,619,250 A 10/1986 Hasegawa
4,644,938 A 2/1987 Yates et al.
4,671,258 A 6/1987 Barthlome
4,763,893 A 8/1988 Barthlome
4,807,606 A * 2/1989 Hasegawa ..... A61H 1/0288 128/DIG. 20
4,830,360 A * 5/1989 Carr, Jr. ..... A63B 23/16 482/47
4,875,469 A 10/1989 Brook et al.
4,907,574 A 3/1990 Hollerbach
5,020,515 A 6/1991 Mann et al.
5,152,740 A 10/1992 Harkensee et al.
5,261,393 A 11/1993 Weinzweig
5,297,541 A 3/1994 Hensey
5,409,447 A * 4/1995 Wedge, Jr. ..... A63B 23/16 128/879
5,413,554 A 5/1995 Trueman
5,437,620 A 8/1995 Shelly
5,453,064 A * 9/1995 Williams, Jr. ..... A63B 23/16 2/161.1
5,466,202 A 11/1995 Stern
5,593,369 A 1/1997 Stern
5,628,069 A 5/1997 Ebert
5,713,834 A * 2/1998 Palmer ..... A61H 9/0021 601/148
5,765,228 A 6/1998 Bieling
6,139,512 A * 10/2000 Ricchio ..... A61H 23/04 4/541.4
6,482,168 B1 11/2002 Betcher
6,547,752 B2 4/2003 Holland et al.
6,673,028 B1 * 1/2004 Argenta ..... A61H 1/0277 482/49
6,733,421 B1 5/2004 Jones
8,152,783 B2 * 4/2012 Swain ..... A61M 1/0088 601/6
8,425,438 B2 * 4/2013 Fujimoto ..... A61H 1/0285 482/47
2003/0054923 A1 * 3/2003 Brassil ..... A63B 21/1449 482/49
2005/0203447 A1 * 9/2005 Pisani ..... A61H 9/00 601/55
2012/0157263 A1 * 6/2012 Sivak ..... A61H 1/0285 482/4

* cited by examiner

THERAPEUTIC HAND EXERCISE DEVICE

The present invention generally relates to a therapeutic hand exercise devise for providing active exercise to a hand for therapeutic or rehabilitation purposes.

BACKGROUND OF THE INVENTION

Loss of function in the hand can occur for numerous reasons which include post fracture of the carpal, metacarpal and phalange bones, dislocation and injury of the joints in the hand, tendon injuries, nerve injuries (lesions), vascular impairment due to venous or arterial damage, muscular and skin injury. Causes of these injuries can be due to chronic and acute conditions and also as a result of trauma. Examples include sporting injuries, road traffic accidents, traumatic industrial injury due to crushing, occupational hand disorders such as RSI (Repetitive Strain Injury), VWF (Vibration induced White Finger) and CTS (Carpal Tunnel Syndrome) plus other causes of nerve compression and burns to the hand (thermal, electrical or chemical).

In order to restore function, reduce deformity and reduce pain it is important that regular therapeutic exercises of the hand are undertaken. This is especially important following reconstructive surgery of the hand following complex fractures or burns. Other reasons for applying hand physiotherapy is in the treatment of degenerative chronic diseases such as (RA) Rheumatoid arthritis, degenerative nerve diseases such as MND (Motor Neuron Diseases) and rehabilitation following a stroke (Acute or Chronic).

Some aims in applying hand exercises include improving blood flow, strengthening weakened muscles, reducing oedema and exercising paralysed or contorted fingers. Additionally it has been shown that following a trauma injury, the patient can be affected by Complex Pain Syndrome, which can be more problematic than the initial injury but is less prevalent if regular therapeutic exercises are undertaken.

Although it is recognised that controlled physical therapy can prevent or reduce long term problems such as distortion, contracture, pain and also improve the range of available movement, there are barriers to applying therapy. The conventional type of therapeutic exercises that have been shown to alleviate the above problems have traditionally been administered by a helper or specialist therapist. These types of exercises are commonly referred to as PROM (Passive Range of Movement). To ensure these exercises are effective they must be undertaken several times a day to prevent contracture. Each individual exercise can take at least 30 minutes and with a physical therapist having 10 or more patients to look after this can become impossible to achieve, resulting in patients not receiving the optimum level of therapy to aid their recovery.

In order to overcome this problem several devices have been conceived in order to reduce the time the therapist needs to spend with the patient by encouraging the patient to carry out the exercise themselves. One such device is described in U.S. Pat. No. 6,733,421 for providing the user a means to perform therapeutic hand exercises. Other orthotic devices for treating contracture and providing rehabilitation are described in U.S. Pat. Nos. 6,547,752, 6,673,028, 6,482,168 and 4,907,574. Sometimes it is desirable to exercise individual digits of the hand independently and U.S. Pat. No. 5,413,554 describes a Hand splint and exerciser device that provides a means to apply tension to an individual finger against which the patient applies an opposing force.

Devices utilising pneumatic inflatable elements as a means to assist in moving the joints of the hand are described in U.S. Pat. Nos. 5,593,369, 5,466,202, 3,937,215, 5,437,620, 5,152,740, 3,581,740, 5,020,515, 4,644,938 and 4,274,399. Generally these devices assist the therapist in moving the fingers away from the palm and cannot exercise individual fingers over the full range of possible movement with the patients' joints in a relaxed state. A Therapeutic Multiple Joint Exerciser is described in U.S. Pat. No. 4,671,258, which teaches a method of utilising air bladders and a combination of sprung steel strips to exercise different joints in the body including the hand. An embodiment is described in which the air bladders and compartments for the sprung steel strips is held in place on the dorsal surface of the hand and held in place by straps around the wrist and by straps around the ends of the fingers.

The physical practicalities of using air as an actuation means may have prevented the use of this technology in a commercial device. Because of the compressible nature of air, in order to generate sufficient force to extend a finger, either a small volume of high pressure air or a large volume of lower pressure air is required. High pressure is not desirable in this application and therefore the volume of the bladder needs to be maximised. In U.S. Pat. No. 4,671,258, large air bladders are described that extend beyond the length of the fingers, which in clinical utility may have some significant practical issues in patient compliance and likely prevent use of the hand for normal activities whilst in use on the hand. A pumping unit suitable for providing an air supply for such a pneumatic exercise device is described in U.S. Pat. No. 4,763,893.

U.S. Pat. No. 4,619,250A describes a therapeutic aid for treatment of the symptoms of carpal tunnel syndrome and similar conditions associated with nerve impairment. A device is described that consists of a wrist splint cloth that has bladders for liquid or air incorporated into the spaces between the fingers. The device utilises a separate pump and control system for inflating and deflating the bladders. Separate bladders are provided for extending and contracting the fingers.

Devices that also administer automatic therapy and do not require the patient to use their own muscles are known as CPM (Continuous Passive Motion) Devices. Generally these devices only require assistance from a therapist in setting the device up. Devices that fall into this category are described in U.S. Pat. Nos. 4,619,250, 4,576,148, 3,937,215, 4,875,469, 5,765,228 and 5,261,393. The CPM devices in general use are typically complex electro-mechanical devices that require significant and skilled setting up, can reduce the mobility of a patient and are often very expensive.

An alternative means of providing an actuation force to straighten the fingers is described in EP421368 and uses an electrical current and a control circuit to intermittently heat a temperature sensitive memory alloy which provides a cyclic exercise. Generally the cost of memory alloys and their associated control systems have precluded them from widespread commercial use.

Each of the prior art devices identified is only intended to provide one of Continuous Passive Motion Therapy (automatic exercise) or Passive Motion Therapy (driven by the patient). The devices are generally not easily portable, tend to be expensive and do not generally promote patient compliance with clinical treatment programmes. Therefore there is a need for a therapeutic hand exercise device which reduces or substantially obviates these problems.

SUMMARY OF THE INVENTION

According to the present invention there is provided a therapeutic hand exercise device comprising:

one or more pliant sleeves for receiving one or more digits of a human hand, a chamber provided in at least a dorsal region of the or each pliant sleeve, a liquid inlet to the chamber, means provided in a Palmar region of the or each pliant sleeve for moving the or each pliant sleeve into a relaxed state, and a pump for supplying pressurised liquid to the or each chamber, the or each pliant sleeve being movable between the relaxed state and a stiffened state in which the pliant sleeve forms a substantially rigid elongate member for holding a finger disposed within the sleeve in an extended position.

Advantageously the device allows automatic extension and contracture exercising of fingers and joints positioned within the pliant sleeves. Further advantages are provided by the use of a pressurised liquid, which can not only transmit sufficient force to extend one or more fingers, but can also transmit vibration and heat to the or each pliant sleeve, as desired. The use of liquid also facilitates miniaturisation and portability of the device as well as enabling the device to be utilised is a passive way, which is not possible with pneumatic systems.

Each pliant sleeve may be moved to the stiffened state when pressurised liquid is pumped into the respective chamber.

A control system may be provided for intermittently pumping liquid into each chamber. The control system enables automatic exercise according to a clinical plan.

A resilient member may be removably connected to the Palmar side of each pliant sleeve. The resilient member may be pre-formed in a curve for providing a biasing force to move the digits of the hand into a contracture position. The resilient member may be pre-formed to provide a biasing force to move the digits of the hand into an extension position. The resilient member may be attached to the pliant sleeve by a self fastening material.

The resilient member further facilitates automatic exercise according to a clinical plan. The stiffness of the resilient member may also be altered to suit the clinical need.

The pump may be disposed in a portable housing connected to the pliable sleeves by flexible conduits.

The device may be battery powered and a battery charging circuit may be contained in a housing with at least one battery.

The control system may control the duration of time that the pump is running. Means may be provided for the control system to monitor and control the pressure and flow-rate of the liquid.

The control system may record and display the frequency of operation of the hand exercise device. Furthermore, the control system may record and display the duration of operation of the hand exercise device.

A manual flow control valve may be provided for each chamber.

Alternatively, an electrically powered valve may be provided for each chamber.

A quick release coupling with integrated shut off valves may be provided for connecting the pump to the chamber to prevent liquid loss, when disconnected. This facilitates simple placement and removal of the device from a patients hand.

Means may be provided to regulate and turn off liquid pressure to one or more of the liquid chambers attached to the digits of the hand to enable selective exercise of individual digits. The ability to exercise specific fingers is useful, particularly if some fingers are injured more than others.

Means may be provided to disable the liquid pressure by switching off the pump and opening a valve to allow free return of liquid into a reservoir, thus allowing passive motion exercise of the hand to occur. In this mode of operation, a therapist can also move the finger joints of the patient in a relaxed state.

An additional liquid chamber may be provided in a Palmar region of each pliant sleeve. The additional liquid may increase the straightening force available, when subjected to a positive liquid pressure.

The additional liquid chamber may provide a contracture force to one or more digits of the hand when subjected to a negative pressure.

The internal construction of the liquid chamber may include internal ribbing to prevent the additional liquid chamber collapsing under a negative pressure.

An interface liner of a breathable material may be provided next to the patient's skin.

A means may be provided for providing an air flow over the surface of the hand.

The means for providing an airflow may include a cover made from semi air permeable material that is adapted to encapsulate the patient's hand and at least part of the device and to provide a means of containing air flow as it is drawn over the patient's skin.

An aperture in the cover may allow air to escape to atmosphere, and a bacteriological filter may be provided over the aperture to prevent micro organisms from entering the atmosphere.

Air may be drawn from the atmosphere and may flow over the hand before being evacuated back to atmosphere.

A bacteriological filter may be provided to prevent microorganisms being drawn in from atmospheric air and deposited over the surface of the hand.

A second bacteriological filter on the outlet of the air source may be provided to prevent microorganisms being evacuated back into the atmosphere.

A manifold material may be provided between the flexible structure of the device and the cover to maintain an air flow path when a negative pressure is applied within the cover.

Means may be provided for transmitting sensory feedback to a patient's hand by transmitting energy through the liquid. The energy transmitted may be thermal.

The liquid may be heated and optionally cooled by a Peltier effect device in a separate portable housing.

The energy transmitted may be in the form of vibrations. The vibrations may be produced by an eccentric motor and cam arrangement in contact with the liquid.

A housing accommodating the pump may be adapted to be attached to the Palmar surface of the hand.

According to a second aspect of the invention there is provided a method of providing therapeutic hand exercises using a device according to a first aspect of the invention, wherein the flexure and contracture of one or more fingers of a hand is provided by stiffening and relaxing of the or each chamber.

The method provides the advantages of gradual and controlled movement of the joints by means of an automated, mechanical movement. Following on from successful motion exercises, strength exercises may be initiated. Use of the device reduces stiffness, increases range of motion and prevents the formation of scar tissue that will limit the motion further. Use of the device improves patient compliance and healing is quickened.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF PREFERRED EMBODIMENT(S)

Figure 1:
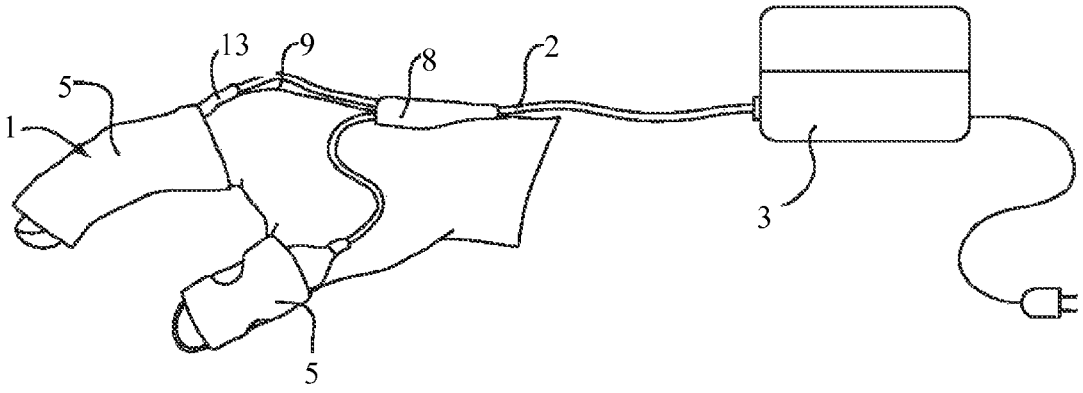
FIG. 1 is a perspective view of a therapeutic hand exercise device.

The first and preferred embodiment of the invention will now be described in detail with reference to FIG. 1. A flexible structure 1, referred to in the rest of this disclosure as a glove, includes a plurality of pliant finger sleeves or tubes 5 for accommodating and encapsulating the fingers and thumb of a patient with a hand injury. The majority of the glove 1 is made from a material that is soft for patient comfort, has elastic properties to accommodate different finger and thumb sizes and also has a hard wearing external layer. Some examples of materials that could be used are neoprene that has a woven fabric backing, or a synthetic elastic fibre such as Spandex, or Elastane.

Figure 2:
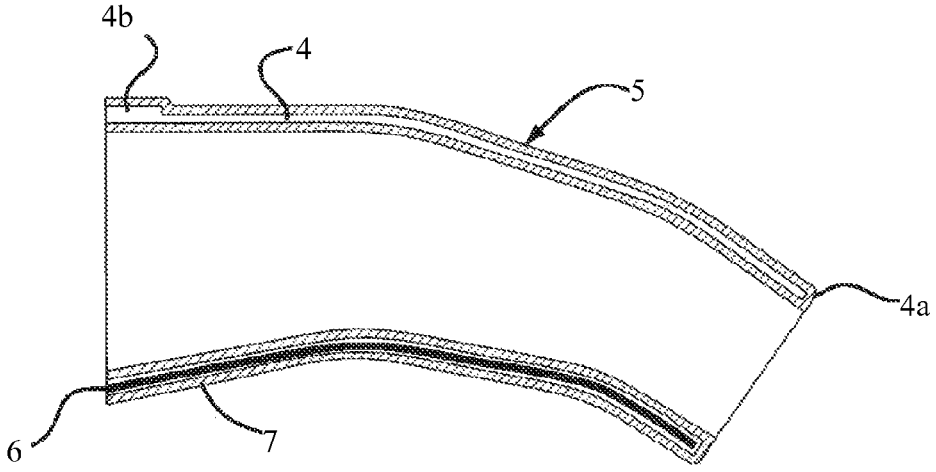
FIG. 2 is a cross sectional view through a finger of the glove shown in FIG. 1.

The glove 1 is connected to an actuation power unit 3 by flexible conduits 2. Referring also to FIG. 2, the glove 1 has liquid compartments 4 which are closed at the distal end 4*a* and connected to the flexible conduits 2 at the proximal end 4*b*. The liquid compartments 4 enable a straightening force to be applied to each individual finger tube 5 of the glove 1. This is achieved by pumping liquid from the power unit 3 through the flexible conduits 2 into the liquid compartments 4. Because the compartments 4 are sealed at the distal end 4*a*, the increase in pressure causes the compartments 4 and hence the finger tubes 5 to straighten or elongate to a fully expanded position, because the compartment and tube are permanently linked in construction. This motion allows the patient fingers and thumb to be moved from a contracture position to a straight position thus exercising the joints through one cycle.

In order to allow the patients hand to complete the next cycle i.e. to return to a contracture position, the liquid pressure in each compartment 4 is released by the power unit 3, which then allows free movement of the glove 1. To aid the return to a contracture position, inserts 6 can optionally be inserted into flexible loops 7 in glove 1. The inserts 6 are pre-formed with a bend so that in a rest position they hold the glove in a position of contracture. The inserts are made from a thermoplastic material with a good memory such as ABS, Nylon, Polypropylene, Polycarbonate, Polyurethane, PVC etc. Alternatively the inserts can be manufactured from a suitable metal which exhibit the correct memory properties and strength such as Stainless Steel or High Carbon steel.

A range of inserts 6 can be made available in different strengths, sizes and degree of contracture. Each insert 6 is held securely in position on the glove 5 by a loop 7 and is inserted by the user or carer into the glove prior to the commencement of therapy. Hence, an appropriate insert can be selected, as required. The device seeks to replicate the hand's natural ligaments as closely as possible by applying opposing forces on either side of the fingers.

Figure 3:
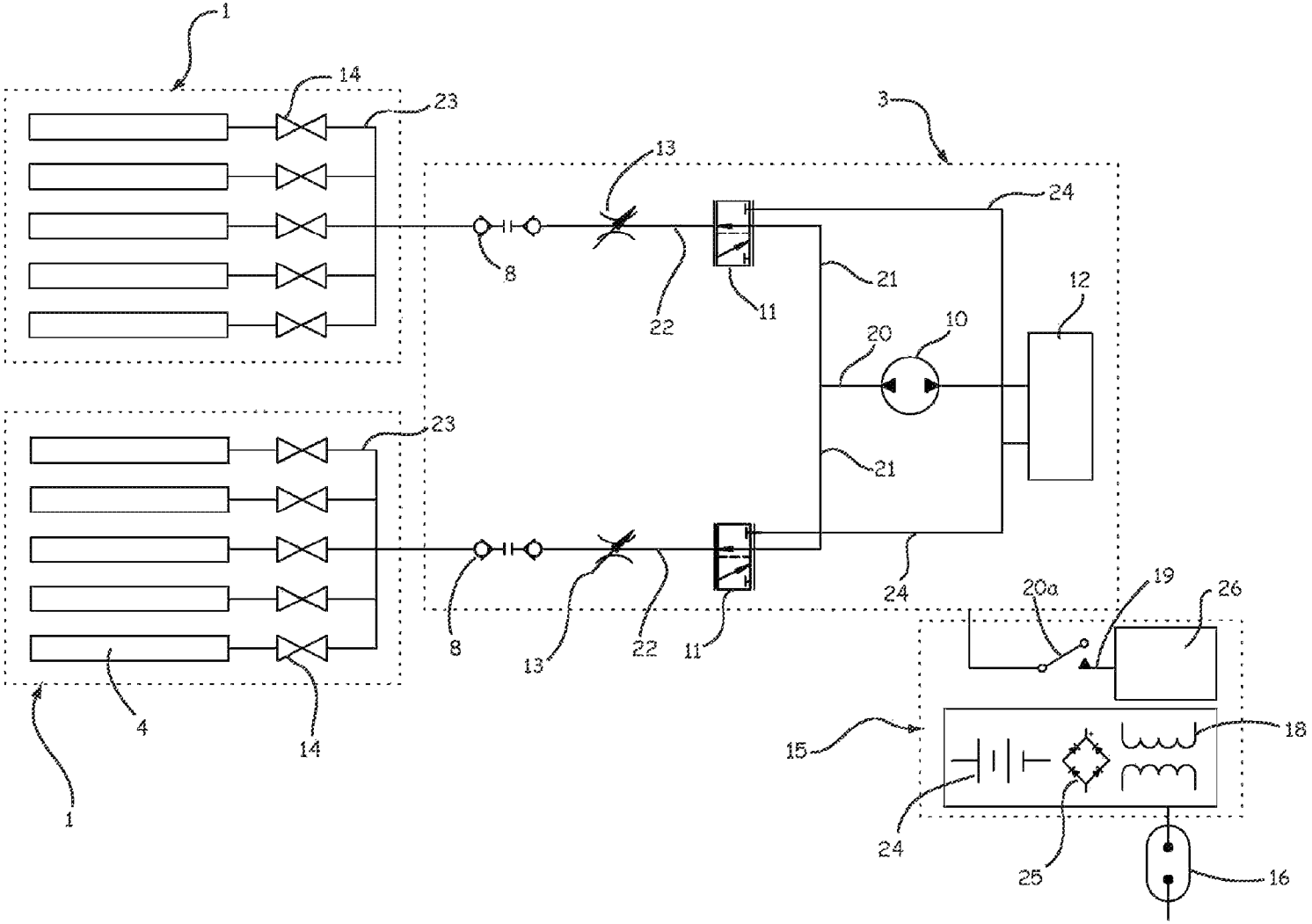
FIG. 3 is a schematic diagram of the device in FIG. 1.

The power unit 3 in FIG. 3 is connected to the finger compartments 5 of the glove by flexible conduit 2 through a valve connector 8, which provides for disconnection of the glove from the power unit 3, when active therapy is not required. The glove incorporates individual miniature manual shut off valves 14, shown in FIG. 3, which are positioned in the flow path of individual conduits 9. The shut off valves 14 provide a means to disable therapy from selected fingers in the case of pain or extreme stiffness. The valve connector 8 incorporates an automatic shut off valve to prevent any liquid leakage when the glove is disconnected. In this mode, with the power source disconnected, the glove can act as a Passive Motion Device (POM) with the patient able to perform exercises themselves, with resistance to extension of the fingers being provided by inserts 6.

The liquid used for actuation of the device can include ionised water, inert mineral oil, and glycerine. The liquid is contained in a closed reservoir 12 which is connected to a pump 10 by a conduit 20. In this embodiment, pump 10 is a small fixed displacement pump with an integrated low voltage motor. On the higher pressure side of pump 10, the liquid path is divided into two conduits 21. Each conduit 21 is connected to valve 11, which is a normally closed solenoid valve suitable for low flow and pressure liquid applications. A conduit 22 is connected to each valve 11 on the output side of the valve. A variable flow regulator 13 is installed in line to control the speed of the actuation. Pump 10 is activated when switch 20*a* is closed and liquid is drawn from reservoir 12 through conduit 20 into the inlet of pump 10, where it is pressurised and then flows through conduit 21 to normally closed valve 11. The actuation of the valve(s) 11 is controlled by a control circuit where both valves could be opened independently or together and intermittently cycled on and off at user selectable time periods depending upon the exercise required by the care provider, therapist or user.

When a valve 11 is open, liquid is passed along a corresponding conduit 22 under pressure and passes through variable flow regulator 13, which can be adjusted to alter flow rate and consequently the speed of actuation of elongation of the liquid compartment 4.

Liquid flows through the valve connector 8, which incorporates an automatic shut off valve. This prevents liquid leaking from conduit 22 when glove 1 is disconnected from power unit assembly 3. After valve 8 the liquid path is divided into individual conduits 23 which feed each liquid compartment 4 of the respective finger tubes 5. Manual shut off valves 14 can be provided in-line to one or all of the conduits 23. Manual shut off valves 14 provide a means of preventing liquid pressure entering liquid compartment 4 and therefore disabling actuation of selected digits in the case of extreme stiffness, deformity or pain. The pressure in liquid compartment 4 during activation cycle could for example range from 50 to 500 mmHg depending on the type of pump used, liquid used, size and design of the glove and the specific patient condition being treated. The effect of the pressurised liquid entering the closed liquid compartment 4, causes the compartment to assume a straight position and consequently each digit of the hand that is placed within the finger tube 5 of the glove will be subjected to a straightening force.

At the end of the straightening cycle the control circuit 26 will determine the hold time which can either be user adjustable or pre-set and could for example range from 30 seconds to 5 minutes. Following the hold time, pump 10 is switched off and valve 11 de-energised. Liquid returning through conduit 22 flows through a common port of valve 11 to a port connected to conduit 24, which returns liquid to reservoir 12. With pump 10 switched off and valve 11 switched to allow free flow back through the valve, the straightening force in each member of the glove is removed. Force to return the digits to a contracture position is provided by insert 6 and the patients own muscles. After a pre-determined time that can be adjusted by the user or care giver in control circuit 26 the cycle is repeated, pump 10 is restarted and valve 11 energised causing liquid compartments 11 to straighten.

An electrical unit 15 includes the control circuit 26, which provides for user adjustment of therapy parameters, ON/OFF switch 20*a* and a low voltage supply cable 19. A low voltage DC supply ranges from 5 to 15 volts and is generated from power supply 15, provided for example, by rechargeable batteries 24. Example battery technology that could be used includes Nickel Metal Hydride (NiMH), nickel-cadmium battery (NiCd), Lithium-ion batteries (Li-ion) or Lithium-ion polymer technology (Li-Pol). A charging circuit 25 and transformer circuit 18 reduces the AC input to a low voltage DC supply. Alternatively a switch mode power circuit may be provided to allow universal voltage inputs for example from 100V to 250V AC. A detachable power lead 16 provides a convenient means to connect AC power to electrical unit 15.

In an alternative embodiment, insert 6 in FIG. 2 is substituted by a liquid compartment on the Palmar surface opposite liquid compartment 4 located on the Dorsal surface of the glove 1. Flexure of the digits is achieved as described in the preferred embodiment ie by pressurising liquid compartment 4 on the Dorsal surface, but is aided by simultaneously pressurising the liquid compartment on the Palmer surface. Contracture is achieved by releasing pressure in the Dorsal compartment and allowing backflow of liquid to the reservoir and at the same time liquid is evacuated from the Palmar compartment. The reduction in volume tends to cause the compartment to collapse but is prevented from doing so by its construction which consists of internal ribbing or internal support. The design of the compartment causes it to buckle in a pre-determined manner as the compartment tries to reduce in length. The effect of this is to draw the hand into contracture. The pressurisation and evacuation of liquid into the liquid compartments 4 is achieved by a pump 10 that operates in a positive or negative pressure mode by reversing its direction. The liquid direction is controlled by one or more valves that control the passage of liquid between the compartments to achieve flexure and contracture as described. The control of the valve and the motor are determined by a control circuit 21 as described in the preferred embodiment.

Figures 4, 5:
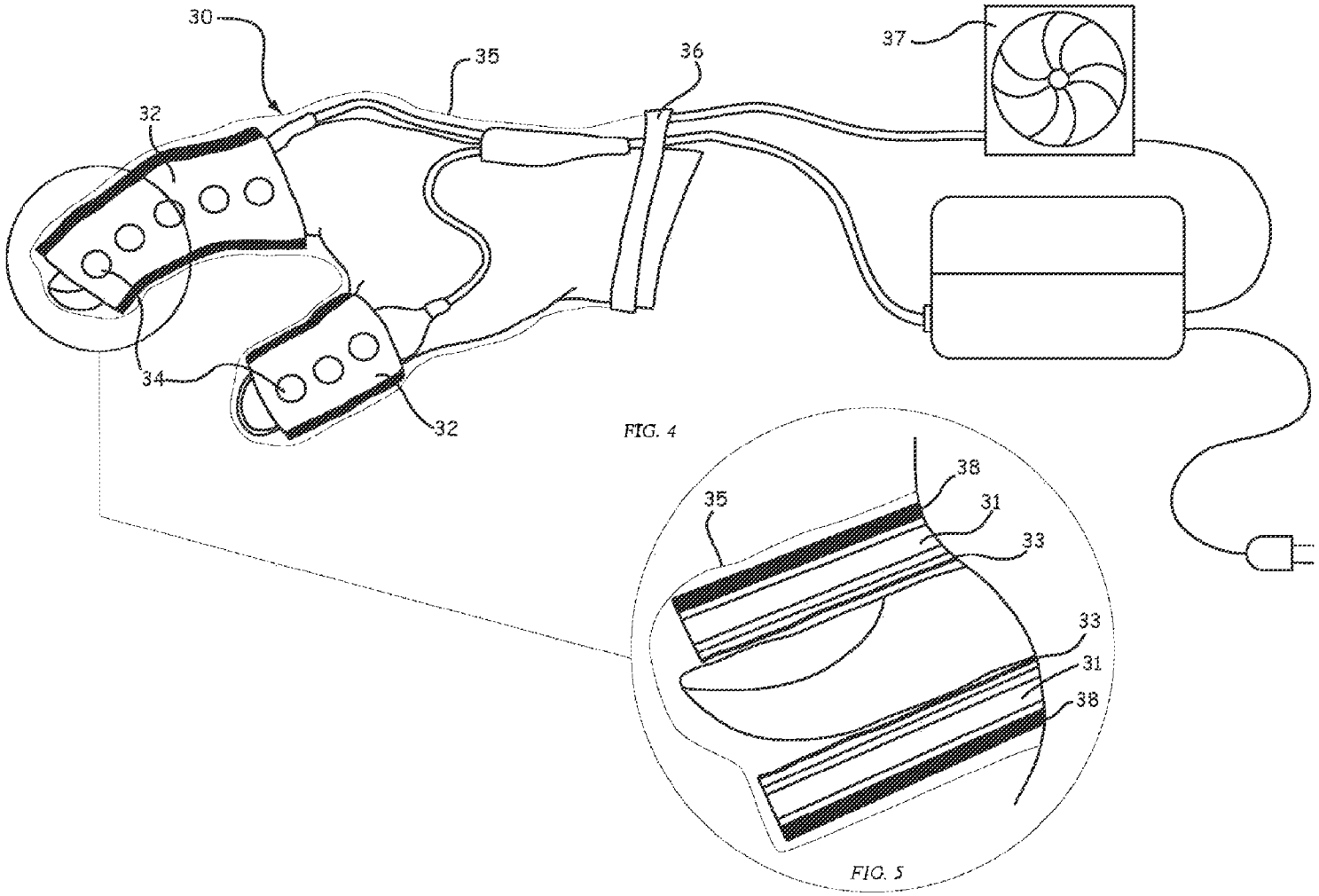
FIG. 4 is a perspective view of an alternative embodiment of a therapeutic hand exercise device.
FIG. 5 is a cross sectional view through part of a finger of the glove shown in FIG. 4.

In a further embodiment shown in FIG. 4 the therapeutic exercise glove 30 is designed for longer duration of use by the patient and is therefore optimised to prevent damage to the skin. Moisture-build up can occur beneath a non-breathable material, which can lead to maceration or in extreme cases skin breakdown resulting in ulceration. By wicking away the moisture from the skin and providing continuous air circulation, the risk of skin damage is reduced. Glove 30 consists of a therapeutic device similar to described with reference to FIG. 1, that allows flexure and contracture of the digits of the hands by the use of liquid pressure. Referring also to FIG. 5, an interface liner 33 in contact with and surrounding the patients digits is manufactured from material that exhibits high breathability quantified by a high Moisture Vapour Transfer Rate (MVTR), which for example, could range from 10,000 $g/m^2/day$ to 25,000 $g/m^2/day$ (ASTM E96E).

An example of a commercially available material of this type that currently is used in other medical applications is Goretex® which is based on expanded polytetrafluoroethylene (PTFE). Interface liner 33 draws moisture from the skin, in order to evaporate the moisture. The continuous wicking by the interface liner 33 creates a low volume air flow over the entire glove. Apertures 34 are present in the sides of the glove and in positions where the liquid compartment 31 do not prevent access to the skin. In order to contain the air flow, the entire glove 32 and substantially the hand is covered by cover 35 which is sealed around the wrist area 36. This cover may envelop the entire glove as a mit or provide openings for each digit. The cover 35 may be manufactured from a light woven or non-woven material that may be semi permeable to air to encourage controlled air flow. For convenience and potential infection control reasons the preferred direction of the air flow may be to draw the air from atmosphere through cover 30 either over the entire surface or in the case where greater filtration is required, through a specific area of the glove that may contain a a High Efficiency Particulate Air (HEPA) filter or a Medical Grade filter material. This may be the case in the treatment of a burnt hand where the risk of infection from airborne bacteria is high. The air flow may be provided by a low volume miniature air fan 37. In order to prevent the cover 35 from collapsing, a manifold material 38 which may consist of an open cell foam such as a Polyurethane reticulated foam may be incorporated on the outer surface of the glove 32. The manifold material 38 still retains an airflow path under partial vacuum because of its pore structure thus allowing continuous air circulation and effective moisture removal. For specific treatment modalities or convenience the air flow may be reversed to gently pressurise the cover 35 and allow the air flow to escape through the cover 35 to atmosphere. The passage of air to atmosphere may also be directed through a filter material either over the whole surface or a portion if there is an infection control concern.

In a further embodiment additional sensory feedback can be supplied to the patient's hand in the form of a temperature change or vibration. This may be of particular importance to patients with neurological disorders such as stroke rehabilitation. The sensory stimulant is provided through the liquid that provides the actuation means. The temperature stimulant is provided by a miniature heating and cooling element such as a peltier effect thermo-electric device which, for example, can be 4-6 mm thick, 40 mm by 40 mm and have a temperature gradient of approximately 70 deg C. This temperature gradient may be used to alter the temperature of the liquid to provide a changing thermal feedback to the patient, controlled by the care giver or therapist by adjusting user available controls in the device. Furthermore, other sensory stimulants may be provided such as vibration through the liquid medium. A small eccentric cam device, similar to that used in mobile telephones, can be provided in the control system that transfers vibration energy to the liquid and in turn to the patient's skin that is in contact with the hand exercise device.

Figure 6:
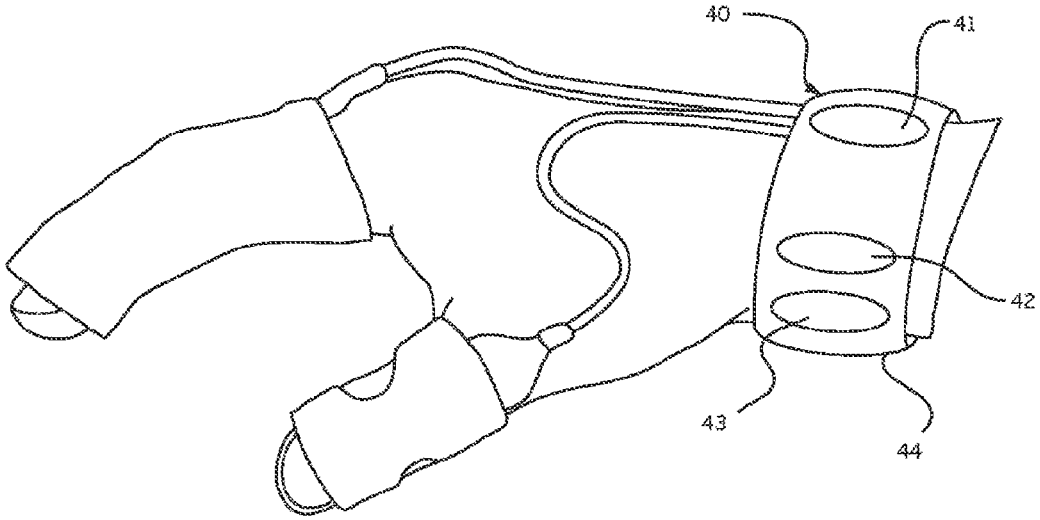
FIG. 6 is a perspective view of a further alternative embodiment of a therapeutic hand exercise device.

In a further embodiment an integrated and combined device 40 is shown in FIG. 6. A control unit 41, power unit 42 and power source 43 are conveniently packaged and miniaturised so there are no inter-connecting leads or external power source. In this embodiment the power source is supplied by disposable or rechargeable batteries. The rechargeable batteries are recharged external to the device.

Liquid conduits are integrated into the design of the device through internal manifolds. The components required to operate the device are arranged so they fit in a wrist band or collar 44 around the patient's wrist.

Figure 7:
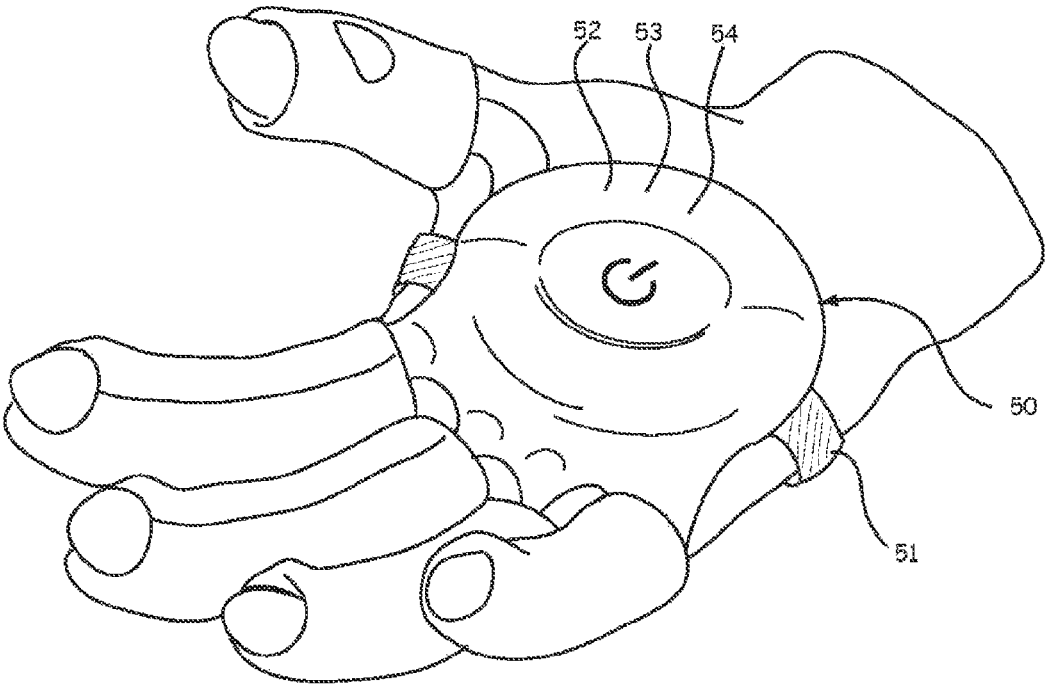
FIG. 7 is a perspective view of a further alternative embodiment of a therapeutic hand exercise device.

A further embodiment is shown in FIG. 7, which contains many of the functional elements included in the previous embodiments described, but packaged in a form that is suitable for patients that can only tolerate a device contacting the Palmar surface of the hand. Unit 50 fits into the palm of the hand and is held in place by elasticated strap 51. The device inflates and deflates by the internal movement of liquid entering liquid compartments within the unit. Liquid reservoir 52, pump 53, and power source 54 are contained within unit 50. Due to the requirement to reduce size and weight, miniature components may be used such as a Piezo electric disc pump of, for example, between 15 mm and 30 mm in diameter and less than 5 mm in thickness. Due to the closed nature of the liquid system the flow rate is not critical but pressures of up to 500 mmHg can be generated by some types of Piezo electric pumps and this is sufficient to provide the forces required to enable therapeutic levels of exercise to the hand. Additional sensory stimulants such as heat and vibration as described in previous embodiments may also be included in this embodiment.

It will be appreciated that the pressure in the chambers and/or the position of the valves 14 can be altered or set to provide variable assistance/resistance when the device is used in the passive mode. The rigidity of the sleeves in the extended position can also be adjusted as desired by controlling the liquid pressure.

The embodiments of therapeutic hand exercise device disclosed are suitable for providing automatic exercising and passive exercising of fingers. They also allow forces applied and rates of movement to be controlled. In particular the miniaturised hydraulic circuits allow sufficient forces to be generated and provide controlled resistance in the passive mode of operation. The device enables accurate and repeatable forces to be applied and the device can be used throughout the rehabilitation of a patients hand injury. The device reduces the burden on therapists, because patents can use the device themselves in many instances, and can follow a clinical, customised rehabilitation programme determined by the therapist.

It is understood that variations may be made in the foregoing without departing from the scope of the invention. For example, the elements and teachings of the various illustrative embodiments may be combined in whole or in part in some or all of the illustrative embodiments. In addition, one or more of the elements and teachings of the various illustrative embodiments may be omitted, at least in part, and/or combined, at least in part, with one or more of the other elements and teachings of the various illustrative embodiments within the scope of the claims.

The invention claimed is:

1. A therapeutic hand exercise device, comprising:

one or more pliant sleeves for receiving one or more digits of a human hand;

a chamber provided in at least a dorsal region of each of the one or more pliant sleeves;

a liquid inlet to the chamber;

means for moving the one or more pliant sleeves into a relaxed state;

a pump for supplying pressurized liquid from a closed reservoir to the liquid inlet of the one or more chambers, the pump disposed between and in communication with the liquid inlet of the one or more chambers and the closed reservoir, the one or more pliant sleeves being movable between the relaxed state and a stiffened state in which the pliant sleeve forms a substantially rigid elongate member for holding a finger disposed within the sleeve in an extended position;

a valve having a first open position and a second open position, the valve disposed between and in communication with the one or more chambers and the pump, the valve disposed between the one or more chambers and the closed reservoir, the valve in communication with the closed reservoir, the valve in communication with the one or more chambers via a first port in the valve, the valve in communication with the pump via a second port in the valve, and the valve in communication with the closed reservoir via a third port in the valve; and an automatic control adapted to control an actuation of the valve and thereby a flow of the pressurized liquid to and from the one or more chambers for automatic exercising of the one or more digits, wherein switching on the pump and opening the valve to the first open position draws the liquid from the closed reservoir to the liquid inlet of the one or more chambers through the second port and the first port of the valve, thereby allowing the supplying of the pressurized liquid to the one or more chambers, and wherein switching off the pump and opening the valve to the second open position allows free return of the liquid into the closed reservoir through the first port and the third port of the valve, thereby allowing passive motion exercise of the hand to occur.

2. The device according to claim 1, wherein the pliant sleeve is moved to the stiffened state when pressurized liquid is pumped into a respective one of the chambers.

3. The device according to claim 1, wherein the means for moving the one or more pliant sleeves into a relaxed state includes a resilient member that is removably connected to a palmar side of the pliant sleeve.

4. The device according to claim 3, wherein the resilient member is attached to the pliant sleeve by a self fastening material.

5. The device according to claim 3, wherein the resilient member is pre-formed in a curve for providing a biasing force to move the digits of the hand into a contracture position.

6. The device according to claim 1, wherein the pump is battery powered and is disposed in a portable housing connected to the pliable sleeves by flexible conduits.

7. The device according to claim 1, wherein the automatic control controls the pump, and a pressure and a flow-rate of the liquid.

8. The device according to claim 1, wherein the automatic control records and displays a frequency of operation and a duration of operation of the hand exercise device.

9. The device according to claim 1, wherein a manual flow control valve is provided for the chamber.

10. The device according to claim 1, wherein an electrically powered valve is provided for the chamber.

11. The device according to claim 1, wherein a quick release coupling with integrated shut off valves connects the pump to the chamber to prevent liquid loss, when disconnected.

12. The device according to claim 1, wherein a means is provided to regulate and turn off liquid pressure to one or more of the liquid chambers attached to the digits of the hand to enable selective exercise of individual digits.

13. The device according to claim 1, wherein the means for moving the one or more pliant sleeves into a relaxed state includes an additional liquid chamber provided in a palmar region of the pliant sleeve for increasing a straightening force available, when subjected to a positive liquid pressure and for providing a contracture force to one or more digits of the hand when subjected to a negative pressure.

14. The device according to claim 13, wherein an internal construction of the liquid chamber includes internal ribbing to prevent the additional liquid chamber collapsing under a negative pressure.

15. The device according to claim 1, wherein an interface liner of a breathable material is configured to be provided next to skin of the human in use.

16. The device according to claim 1, wherein a means is provided for providing an air flow over a surface of the hand, the means including a cover made from semi air permeable material that is adapted to encapsulate the hand of the human and at least part of the device and to provide a means of containing air flow as it is drawn over skin of the human.

17. The device according to claim 16, wherein a first bacteriological filter is provided to prevent micro organisms from entering the atmosphere and a second bacteriological filter is provided to prevent microorganisms being drawn in from atmospheric air and deposited over the surface of the hand.

18. The device according to claim 1, wherein means is provided for transmitting sensory feedback to a patient's hand through the liquid by vibration, heating or cooling.

19. A therapeutic hand exercise device, comprising:

one or more pliant sleeves for receiving one or more digits of a human hand;

a chamber provided in at least a dorsal region of each of the one or more pliant sleeves;

a liquid inlet to the chamber;

one or more resilient members connected to a palmar side of the one or more pliant sleeves for moving the one or more pliant sleeves into a relaxed state;

a pump for supplying pressurized liquid from a closed reservoir to the liquid inlet of the one or more chambers, the pump disposed between and in communication with the liquid inlet of the one or more chambers and the closed reservoir, the one or more pliant sleeves being movable between the relaxed state and a stiffened state in which the pliant sleeve forms a substantially rigid elongate member for holding a finger disposed within the sleeve in an extended position;

a valve having a first open position and a second open position, the valve disposed between and in communication with the one or more chambers and the pump, the valve disposed between the one or more chambers and the closed reservoir, the valve in communication with the closed reservoir, the valve in communication with the one or more chambers via a first port in the valve, the valve in communication with the pump via a second port in the valve, and the valve in communication with the closed reservoir via a third port in the valve; and an automatic control adapted to control an actuation of the valve and thereby a flow of the pressurized liquid to and from the one or more chambers for automatic exercising of the one of more digits, wherein switching on the pump and opening the valve to the first open position draws the liquid from the closed reservoir to the liquid inlet of the one or more chambers through the second port and the first port of the valve, thereby allowing the supplying of the pressurized liquid to the one or more chambers, and wherein switching off the pump and opening the valve to the second open position allows free return of the liquid into the closed reservoir through the first port and the third port of the valve, thereby allowing passive motion exercise of the hand to occur.

20. A therapeutic hand exercise device, comprising:

one or more pliant sleeves for receiving one or more digits of a human hand;

a chamber provided in at least a dorsal region of each of the one or more pliant sleeves;

an additional liquid chamber provided in a palmar region of the one or more plaint sleeves for moving the one or more pliant sleeves into a relaxed state a liquid inlet to the chamber and the additional liquid chamber;

a pump for supplying pressurized liquid from a closed reservoir to the liquid inlet of the one or more chambers and the additional liquid chamber, the pump disposed between and in communication with the liquid inlet of the one or more chambers and the closed reservoir, the one or more pliant sleeves being movable between the relaxed state and a stiffened state in which the pliant sleeve forms a substantially rigid elongate member for holding a finger disposed within the sleeve in an extended position;

a valve having a first open position and a second open position, the valve disposed between and in communication with the one or more chambers and the pump, the valve disposed between the one or more chambers and the closed reservoir, the valve in communication with the closed reservoir, the valve in communication with the one or more chambers via a first port in the valve, the valve in communication with the pump via a second port in the valve, and the valve in communication with the closed reservoir via a third port in the valve; and an automatic control adapted to control an actuation of the valve and thereby a flow of the pressurized liquid to and from the one or more chambers and the additional liquid chamber for automatic exercising of the one of more digits, wherein switching on the pump and opening the valve to the first open position draws the liquid from the closed reservoir to the liquid inlet of the one or more chambers through the second port and the first port of the valve, thereby allowing the supplying of the pressurized liquid to the one or more chambers, and wherein switching off the pump and opening the valve to the second open position allows free return of the liquid into the closed reservoir through the first port and the third port of the valve, thereby allowing passive motion exercise of the hand to occur.

* * * * *